US008344833B1

(12) United States Patent
Baldauf et al.

(10) Patent No.: US 8,344,833 B1
(45) Date of Patent: Jan. 1, 2013

(54) ELECTRIC MACHINE INCLUDING A SWITCH TERMINAL AND METHOD OF CONNECTING AN END PORTION OF A WIRE TO A TERMINAL OF AN ELECTRIC MACHINE

(75) Inventors: Dale Lee Baldauf, Fishers, IN (US); Michael Alan McCord, Anderson, IN (US); Ronald Dale Gentry, Cicero, IN (US)

(73) Assignee: Remy Technologies, L.L.C., Pendleton, IN (US)

( * ) Notice: Subject to any disclaimer, the term of this patent is extended or adjusted under 35 U.S.C. 154(b) by 0 days.

(21) Appl. No.: 13/291,574

(22) Filed: Nov. 8, 2011

(51) Int. Cl.
*H01H 9/02* (2006.01)
*H01H 13/04* (2006.01)

(52) U.S. Cl. ..... 335/202; 336/192

(58) Field of Classification Search ..... 335/220–229, 335/281, 282, 202; 251/129.15–129.17; 336/192
See application file for complete search history.

(56) References Cited

U.S. PATENT DOCUMENTS

| | | | | |
|---|---|---|---|---|
| 4,086,553 | A * | 4/1978 | Robandt et al. | 336/192 |
| 5,673,011 | A * | 9/1997 | Okihara et al. | 335/78 |
| 6,628,187 | B2 * | 9/2003 | Hashimoto et al. | 336/198 |
| 7,038,563 | B2 * | 5/2006 | Andoh et al. | 335/126 |
| 7,545,248 | B2 * | 6/2009 | Imanishi et al. | 335/202 |
| 7,549,899 | B2 * | 6/2009 | Imanishi et al. | 439/877 |
| 7,570,138 | B2 * | 8/2009 | Hirabayashi | 335/131 |

* cited by examiner

*Primary Examiner* — Bernard Rojas
(74) *Attorney, Agent, or Firm* — Cantor Colburn LLP

(57) ABSTRACT

An electric machine includes a wire conductor having at least one end, a terminal configured to be operatively connected to the at least one end of the wire conductor, and a terminal member having a first end section configured and disposed to establish a mechanical bond and an electrical connection with the at least one end of the wire conductor, and a second end section configured and disposed to establish a mechanical link and an electrical connection with the terminal.

18 Claims, 6 Drawing Sheets

ELECTRIC MACHINE INCLUDING A SWITCH TERMINAL AND METHOD OF CONNECTING AN END PORTION OF A WIRE TO A TERMINAL OF AN ELECTRIC MACHINE

BACKGROUND OF THE INVENTION

Exemplary embodiments pertain to the art of electric machines and, more particularly, to an electric machine including a switch terminal.

Many electric machines include field coils formed from wire through which passes an electrical current. The wire generally includes end portions that are connected to terminals configured to connect with an external current source or deliver electrical current to an external load. In many cases, the wire passes through a center portion of the terminal secured with an amount of solder. The amount of solder establishes an electrical connection between the wire and the terminal. In other cases, the wire is simply soldered to an end portion of the terminal.

BRIEF DESCRIPTION OF THE INVENTION

Disclosed is an electric machine including a wire conductor including at least one end, a terminal configured to be operatively connected to the at least one end of the wire conductor, and a terminal member having a first end section configured and disposed to establish a mechanical bond and an electrical connection with the at least one end of the wire conductor, and a second end section configured and disposed to establish a mechanical link and an electrical connection with the terminal.

Also disclosed is a magnetic switch including a housing, and a coil assembly arranged within the housing. The coil assembly includes a wire conductor having at least one end. A terminal is mounted externally to the housing, and a terminal member mounted within the housing between the coil assembly and the terminal. The terminal member includes a first end section configured and disposed to establish a mechanical bond and an electrical connection with the at least one end of the wire conductor, and a second end section configured and disposed to establish a mechanical link and an electrical connection with the terminal.

Further disclosed is a method of connecting an end portion of a wire to a terminal of an electric machine includes mechanically bonding a first end of the wire to a first end section of a terminal member, establishing an electrical connection between the first end of the wire and the first end section of the terminal member, inserting a second end section of the terminal member into an opening formed in a terminal, mechanically linking the second end section of the terminal member to the terminal, and establishing an electrical connection between the second end section of the terminal member and the terminal.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
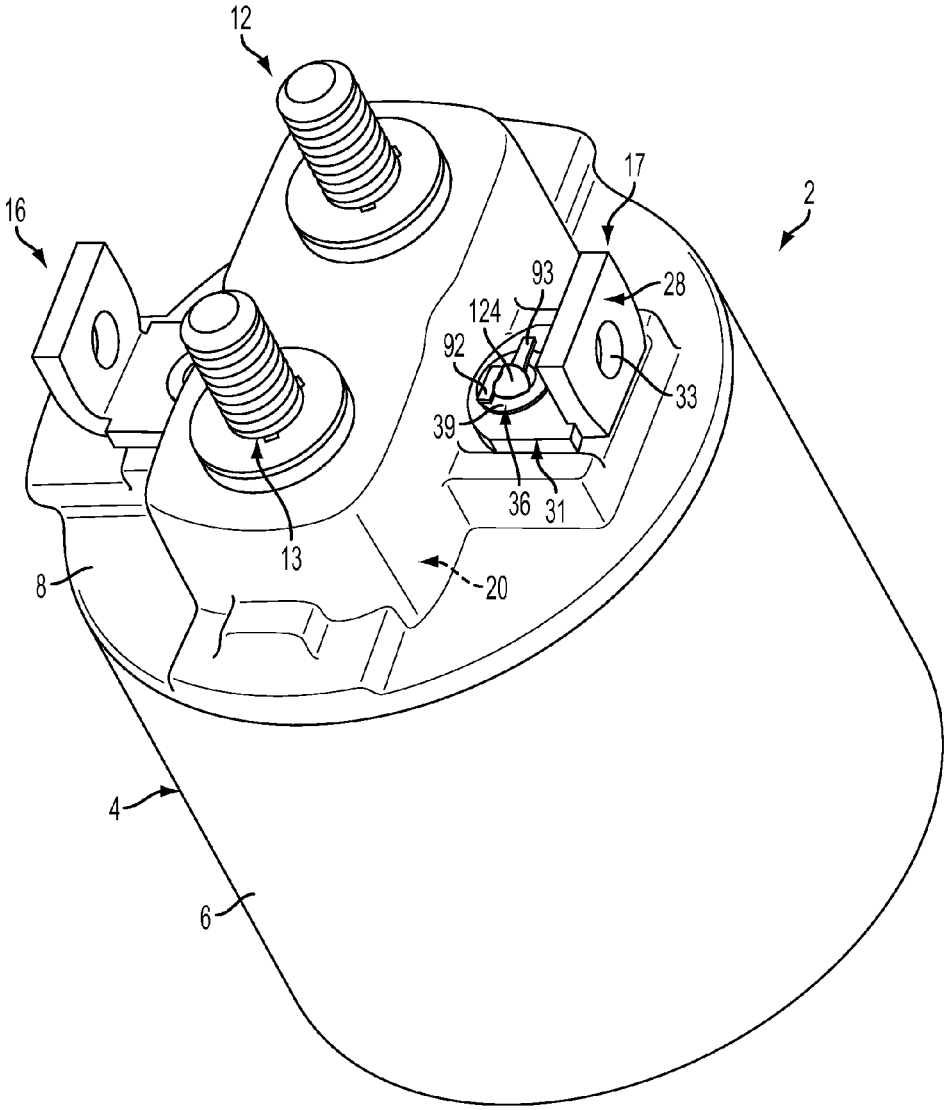
FIG. 1 depicts an electric machine having a switch terminal in accordance with an exemplary embodiment.
Figure 2:
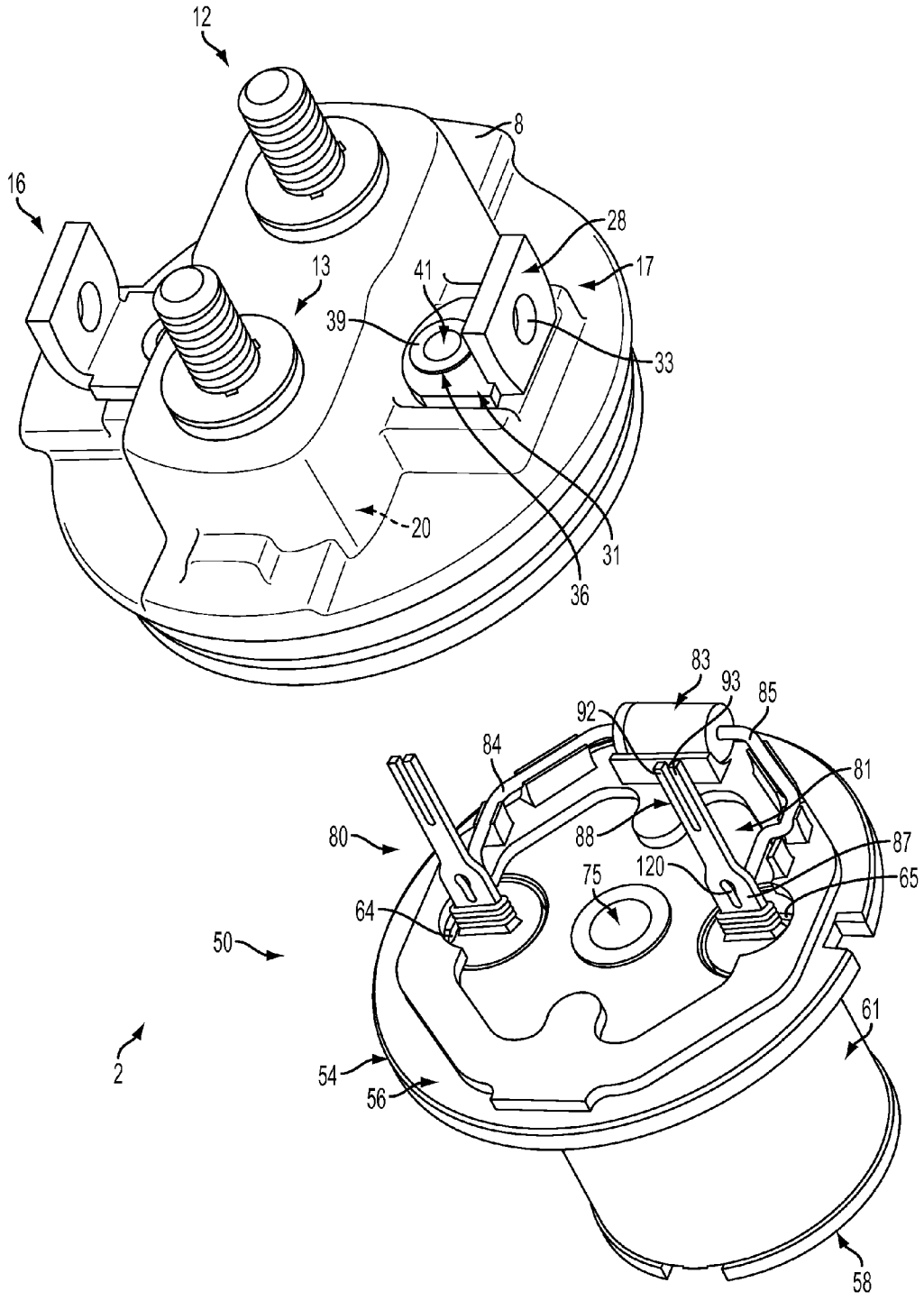
FIG. 2 depicts the electric machine of FIG. 1 after removal of a housing portion to illustrate first and second terminal members electrically connected and mechanically bonded to a wire extending from a coil assembly.

An electric machine constructed in accordance with an exemplary embodiment is indicated generally at 2 in FIGS. 1 and 2. Electric machine 2 is depicted as a magnetic switch or solenoid. However, it should be readily apparent that electric machine 2 could take on a variety of forms. Electric machine 2 includes a first housing member 6 coupled to a second housing member 8. Second housing member 8 supports first and second switched terminals 12 and 13 and first and second control terminals 16 and 17. In accordance with one aspect of the exemplary embodiment, upon application of an electrical current to first and second control terminals 16 and 17, electric machine activates a switch assembly 20 provided within second housing member 8. Switch assembly 20 electrically connects first and second switched terminals 12 and 13.

As each control terminal 16 and 17 is substantially similarly constructed, a detailed description will follow with reference to control terminal 17 with an understanding that control terminal 16 may include similar structure. Control terminal 17 includes a first terminal portion 28 that projects substantially perpendicularly from a second terminal portion 31. First terminal portion 28 includes an opening 33 configured to receive a conductor (not shown) connected to an external component (also not shown). Similarly, second terminal portion 31 includes an opening (not shown) that receives a connector member 36 that secures second control terminal 17 to second housing member 8. Connector member 36 includes a connecting surface 39 that defines an opening 41 which leads into first housing member 6.

In further accordance with the exemplary embodiment, electric machine 2 includes a coil assembly 50 housed within first housing member 6. Coil assembly 50 includes a main body 54 having a terminal member support portion 56 and a coil support portion 58. Coil support portion 58 supports a coil of wire 61 having first and second ends 64 and 65. Main body 54 also includes a passage 75 for an actuator (not shown) that is configured to operate switch assembly 20. More specifically, application of an electrical current to first and second ends 64 and 65 of wire 61 creates a magnetic force that urges the actuator (not shown) into operational engagement with switch assembly 20. Thus, in accordance with the exemplary embodiment, electric machine 2 includes first and second terminal members 80 and 81 that provide a robust interface between first and second ends 64 and 65 of coil of wire 61 and first and second control terminals 16 and 17. Terminal members 80 and 81 also provide a robust connection for a diode 83 that conditions current flow through wire 61. Diode 83 includes a first diode terminal 84 coupled to first terminal member 80 and a second diode terminal 85 coupled to second terminal member 81.

Figure 3:
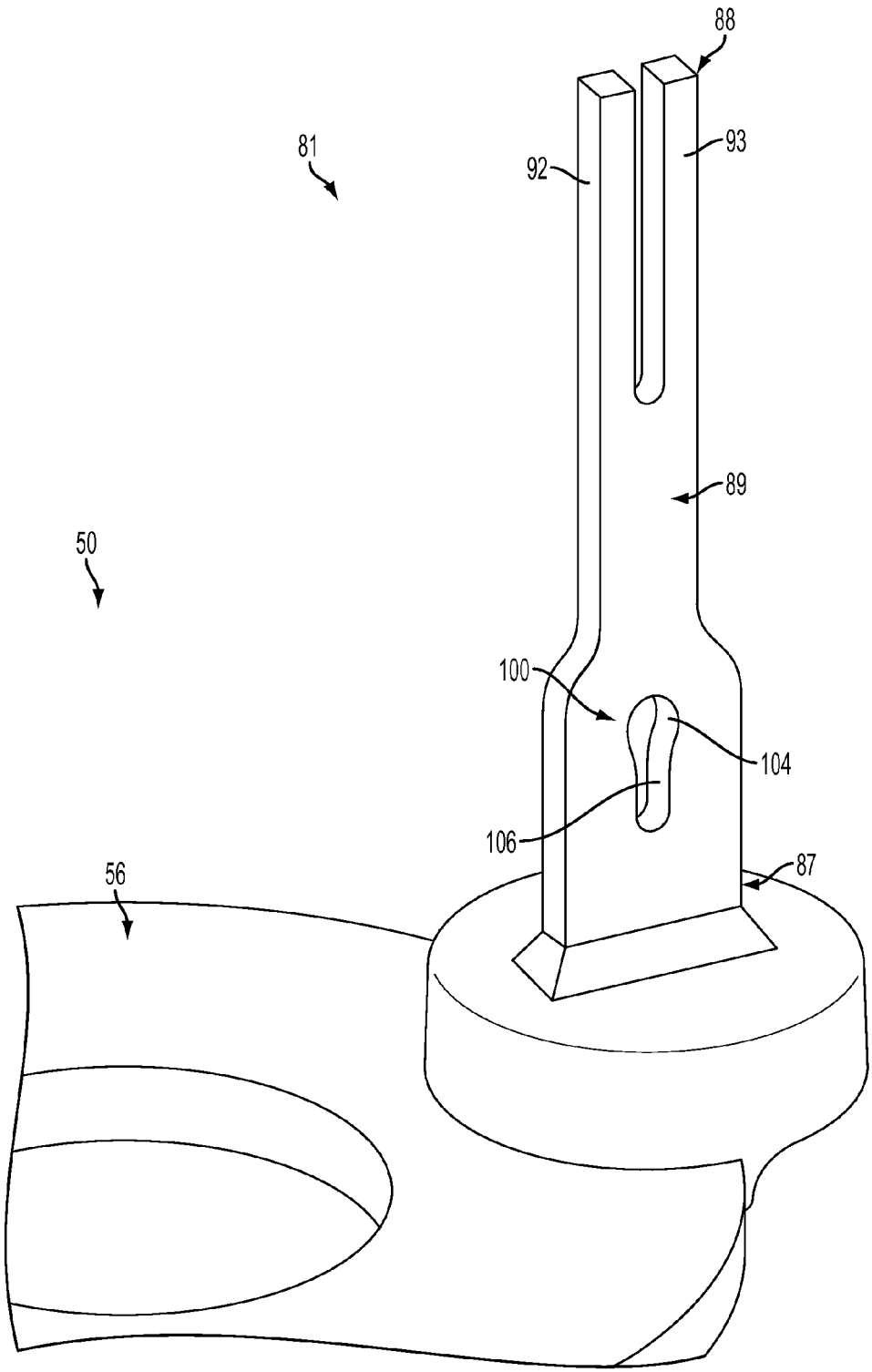
FIG. 3 depicts one of the first and second terminal members of FIG. 2.

As each terminal member 80, 81 is similarly formed, a detailed description will follow with reference to FIG. 3 in describing second terminal member 81 with an understanding that first terminal member 80 may include similar structure. In further accordance with the exemplary embodiment, second terminal member 81 includes a first end section 87 that extends to a second end section 88 through an intermediate section 89. Second end section 88 includes first and second connector members 92 and 93 that facilitate a mechanical link and an electrical connection with second control terminal 17 as will be discussed more fully below. Second terminal member 81 is also shown to include a keyhole shaped opening 100 formed in intermediate section 89. Keyhole shaped opening 100 includes a first opening portion 104 and a second opening portion 106. First opening portion 104 includes a size that is greater than an outer perimeter length of second diode terminal 85 while second opening portion 106 includes a size that is smaller than the outer perimeter length of second diode terminal 85.

Figure 4:
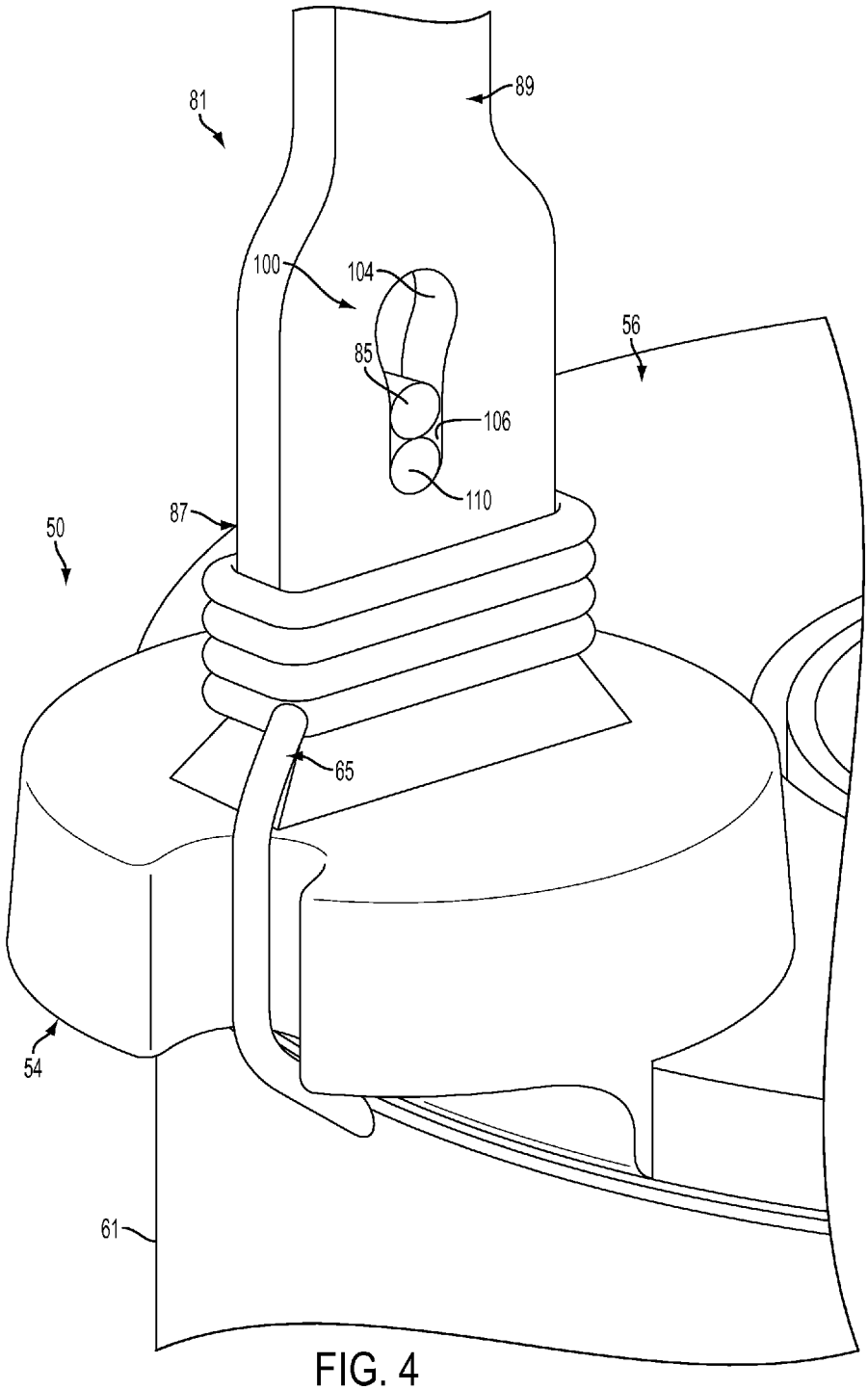
FIG. 4 depicts the wire mechanically bonded to an end portion of the terminal member of FIG. 3.

In still further accordance with the exemplary embodiment, insulation is removed from first and second ends 64 and 65 of coil of wire 61. Second end 65 is coiled about first end section 87 of second terminal member 81 as shown in FIG. 4. A free end 110 of second end 65 is inserted into first opening portion 104 and placed into second opening portion 106 to facilitate a mechanical retention between coil of wire 61 and second terminal member 81. At this point, second diode terminal 85 is also passed into first opening portion 104 and forced into second opening portion 106 to facilitate a mechanical bond between second diode terminal 85 and second terminal member 81. At this point an amount of solder 120 (FIG. 2) is applied to facilitate an electrical connection between coil of wire 61, second diode terminal 85 and second terminal member 81. First end 64 and first diode terminal 84 are connected to first terminal member 80 in a similar fashion.

Figure 5:
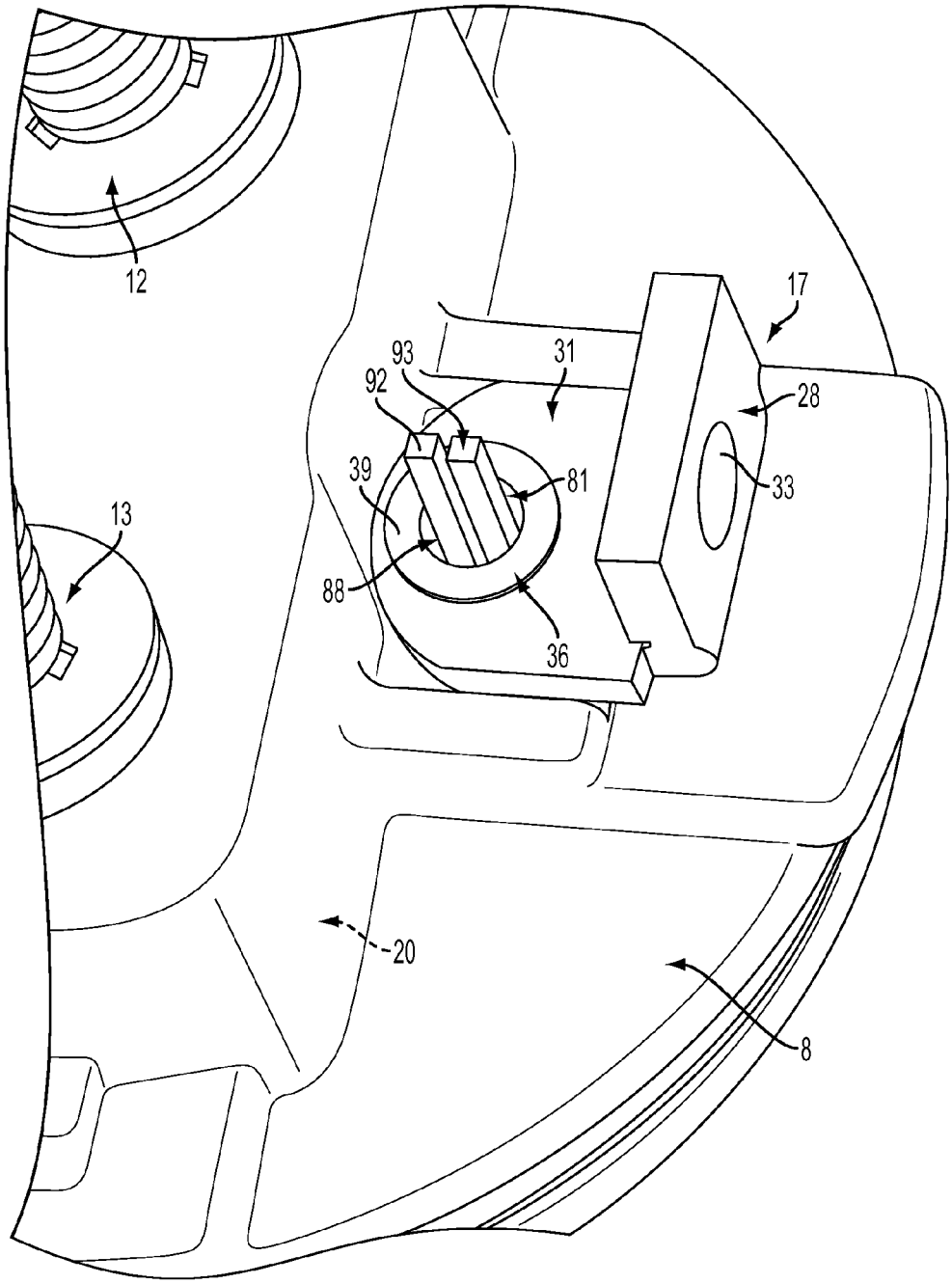
FIG. 5 depicts the terminal member passing through an opening of the terminal of FIG. 1.
Figure 6:
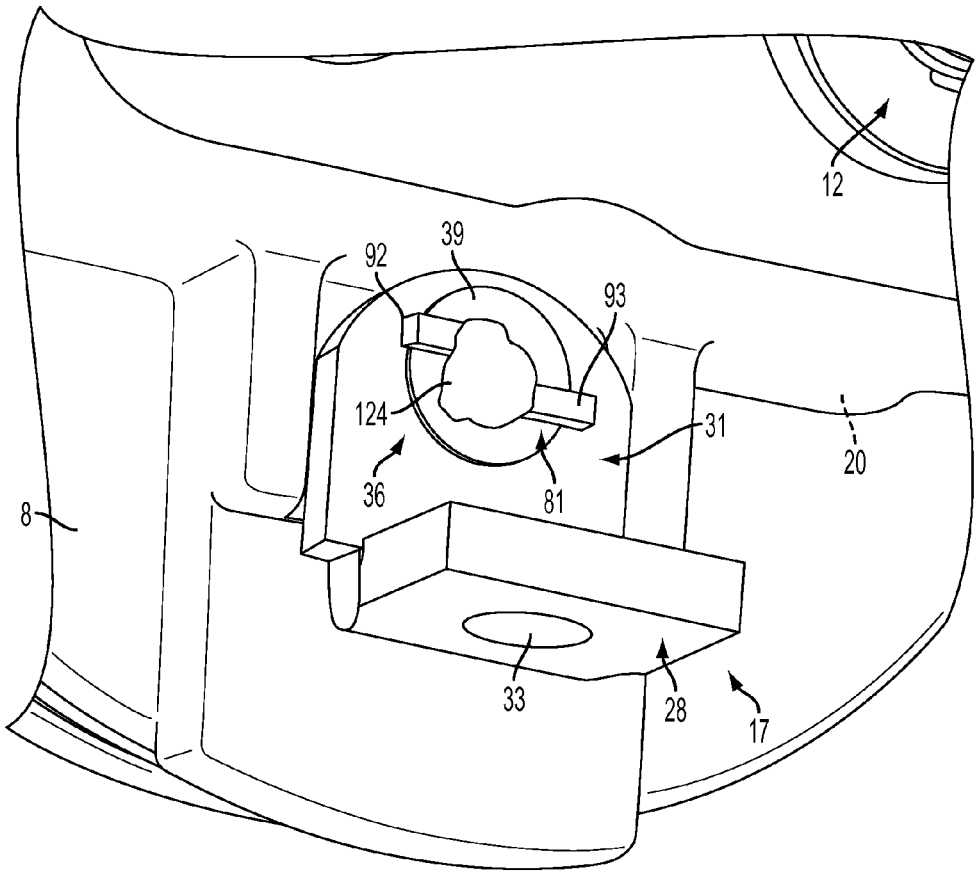
FIG. 6 depicts the terminal member establishing a mechanical link with the terminal of FIG. 1.

After first and second ends 64 and 65 of coil of wire 61, as well as first and second diode terminals 84 and 85 are mechanically bonded and electrically connected to first and second terminal members 80 and 81, second housing portion 8 is positioned upon first housing portion 6 with first and second terminal members 80 and 81 passing through first and second control terminals 16 and 17. As best shown in FIG. 5, first and second connecting members 92 and 93 pass through opening 41 in connector member 36 and are deformed (FIG. 6) so as to engage with connecting surface 39 to establish a mechanical link between second terminal member 81 and second control terminal 17. Once the mechanical link is established, an amount of solder 124 (FIG. 1) is applied to first and second connecting members 92 and 93 to facilitate an electrical connection between second end 65 of coil of wire 61, second diode terminal 85, and second control terminal 17. At this point, first housing portion 6 is joined to second housing portion 8. First terminal member 80 is connected to first control terminal 16 in a similar fashion.

At this point it should be understood that the exemplary embodiments provide a system for establishing a robust connection between wire in an electrical machine and a terminal configured to connect with an external component. The robust connection includes both mechanical and electrical elements that are more capable of withstanding external as well as internal forces such as vibration that may otherwise lead to degradation in the electrical connection. In addition to providing a more robust connection, the exemplary embodiment described herein leads to a more simplified construction that reduces fabrication costs. Also, the exemplary embodiment provides a simple, reliable system for connecting an internal diode in parallel with a solenoid coil.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An electric machine comprising:

a wire conductor including at least one end;

a terminal configured to be operatively connected to the at least one end of the wire; and a terminal member having a first end section, a second end section and an opening positioned between the first and second end sections, the at least one end of the wire extending into the opening and being joined to the terminal member through a mechanical bond and electrical connection, the second end section being configured and disposed to establish a mechanical link and an electrical connection with the terminal.

2. The electric machine according to claim 1, wherein the terminal includes a connecting surface having an opening, the second end section of the terminal member being configured and disposed to extend through the opening and engage the connecting surface to establish the mechanical link.

3. The electric machine according to claim 2, wherein the second end section of the terminal member includes a first connecting member and a second connecting member, each of the first and second connecting members being configured and disposed to be independently deformed to engage the connecting surface to establish the mechanical link.

4. The electric machine according to claim 2, further comprising: an amount of solder arranged at the second end section of the terminal member, the amount of being configured and disposed to facilitate the electrical connection with the terminal.

5. The electric machine according to claim 1, further comprising: a diode having a first diode terminal and a second diode terminal, the opening includes a first opening portion having a size that is greater than a size of an outer perimeter of at least one of the first and second diode terminals and a second opening portion having a size that is less than the size of the outer perimeter of the one of the first and second diode terminals.

6. The electric machine according to claim 1, wherein a portion of the at least one end of the wire conductor is coiled about the first end section of the terminal member.

7. A magnetic switch comprising:

a housing;

a coil assembly arranged within the housing, the coil assembly including a wire conductor having at least one end;

a terminal mounted externally to the housing; and a terminal member mounted within the housing between the coil assembly and the terminal, the terminal member including a first end section, a second end section and an opening positioned between the first and second end sections, the at least one end of the wire conductor extending into the opening and being joined to the terminal member through a mechanical bond and an electrical connection, the second end section being configured and disposed to establish a mechanical link and an electrical connection with the terminal.

8. The magnetic switch according to claim 7, wherein the terminal includes a connecting surface having an opening, the second end section of the terminal member being configured and disposed to extend through the opening and engage the connecting surface to establish the mechanical link.

9. The magnetic switch according to claim 8, wherein the second end section of the terminal member includes a first connecting member and a second connecting member, each of the first and second connecting members being configured and disposed to be independently deformed to engage the connecting surface to establish the mechanical link.

10. The magnetic switch according to claim 8, further comprising: an amount of solder arranged at the second end section of the terminal member, the amount of being configured and disposed to facilitate the electrical connection with the terminal.

11. The magnetic switch according to claim 7, further comprising: a diode having a first diode terminal and a second diode terminal, the opening includes a first opening portion having a size that is greater than a size of an outer perimeter of at least one of the first and second diode terminals and a second opening portion having a size that is less than the size of the outer perimeter of the one of the first and second diode terminals.

12. The magnetic switch according to claim 7, wherein a portion of the at least one end of the wire conductor is coiled about the first end section of the terminal member.

13. A method of connecting an end portion of a wire conductor and a diode terminal to a terminal of an electric machine, the method comprising:

inserting a first end of the wire conductor through an opening formed in the terminal member;

mechanically retaining the first end of the wire conductor to a first end section of a the terminal member at the opening;

establishing an electrical connection between the first end of the wire conductor and the first end section of the terminal member at the opening;

inserting a second end section of the terminal member into an opening formed in a terminal;

mechanically linking the second end section of the terminal member to the terminal; and establishing an electrical connection between the second end section of the terminal member and the terminal.

14. The method of claim 13, wherein mechanically retaining the first end of the wire conductor to the terminal member further includes coiling the first end of the wire conductor about the first end section of the terminal member.

15. The method of claim 14, wherein mechanically retaining the first end of the wire conductor to the terminal member further capturing a diode terminal in the opening, the opening having a size that is smaller than a size of an outer perimeter of the diode terminal.

16. The method of claim 15, wherein establishing the electrical connection between the first end of the wire conductor and the first end section of the terminal member further includes soldering the first end of the wire conductor and the diode terminal to the first end section of the terminal member.

17. The method of claim 13, wherein mechanically linking the second end section of the terminal member to the terminal includes:

passing the second end section of the terminal member through an opening formed in the terminal; and deforming a connecting member provided at the second end section of the terminal member to engage with the terminal.

18. The method of claim 17, wherein establishing the electrical connection between the second end section of the terminal member and the terminal includes soldering the connecting member to the terminal.

* * * * *